United States Patent [19]

Carlson et al.

[11] 4,238,966

[45] Dec. 16, 1980

[54] BELT DRIVE FOR PUMP JACK

[76] Inventors: Russell R. Carlson, Wessington Springs, S. Dak. 57382; John J. Tschetter, P.O. Box 315, Huron, S. Dak. 57350

[21] Appl. No.: 867,132

[22] Filed: Jan. 5, 1978

[51] Int. Cl.[3] ..... F16H 21/32

[52] U.S. Cl. ..... 74/41

[58] Field of Search ..... 74/41

[56] References Cited

U.S. PATENT DOCUMENTS

| | | | |
|---|---|---|---|
| 2,071,437 | 2/1937 | Searle | 74/41 |
| 2,242,252 | 5/1941 | Lightfoot | 74/41 |
| 2,244,812 | 6/1941 | Taylor, Sr. | 74/41 |
| 2,526,561 | 10/1950 | Keltner | 74/41 |

*Primary Examiner*—Samuel Scott
*Assistant Examiner*—Wesley S. Ratliff, Jr.
*Attorney, Agent, or Firm*—John C. Barnes

[57] ABSTRACT

The pump drive mechanism provides a high reduction drive from a continuous operating motor to a crank arm to oscillate the counterbalanced jack for a pump as used in the oil field. The drive utilizes three series of belts to obtain a reduction of 190 to 1. The belt drive reduces downtime and improves the efficiency of drives for pump jacks.

1 Claim, 2 Drawing Figures

BELT DRIVE FOR PUMP JACK

BACKGROUND OF THE INVENTION

This invention relates to an improved pump operating mechanism and in one aspect to an improved drive system for pumping units for oil and other wells of the kind in which a pump comprising a cylinder and a piston are located in the well and operated by means of a pumping string connecting the piston to a pump jack located above ground.

FIELD OF THE INVENTION

Prior art drive systems for pump jacks have utilized gear drives from a motor or engine to a crank which drove a fly wheel upon which a Pitman arm was located to operate the pump jack for the oil well pumps. Such drive systems are described in the literature and one patent which discloses a pumping unit of that type is U.S. Pat. No. 3,154,387, issued Mar. 14, 1963 to G. H. Sadouet. Alternatively, the motor drove a crankshaft which was counterbalanced to drive the pump jack.

The pump operating mechanism of the present invention is motor driven but has a speed reducing belt drive which affords a drive mechanism which will be repairable easily in the event of wear or failure. Also, maintenance will be economically accomplished by replacement of the drive belt.

It is an object of the present invention to provide sufficient reduction in a belt drive utilizing three series of belts to drive the jack head at a rate suitable for use in the oil field pump.

SUMMARY OF THE PRESENT INVENTION

The pump operating mechanism of the present invention comprises a motor having an output pulley which drives a first driven shaft having a driven pulley and a drive pulley to drive a second driven pulley of a size corresponding to that of the first driven pulley. The second driven pulley is mounted on a shaft having a pair of drive pulleys which drive a pair of driven pulleys having a diameter corresponding to the previous driven pulleys. The final driven pulleys are mounted on a shaft to which are connected the crank arm for driving the pump jack through a connecting link pivoted to the crank arm and to the walking beam. The pump jack comprises a counter-weighted beam pivotally mounted about a supporting frame, to the head of which is attached the string to the well pump piston.

This device is the first known high reduction belt drive for pump jacks which eliminate gear drives which are more difficult to repair, less economical and more subject to failure.

DESCRIPTION OF THE DRAWING

The present invention will be described more fully hereinafter with reference to the attached drawing wherein.

DETAILED DESCRIPTION OF THE PRESENT INVENTION

Figure 1:
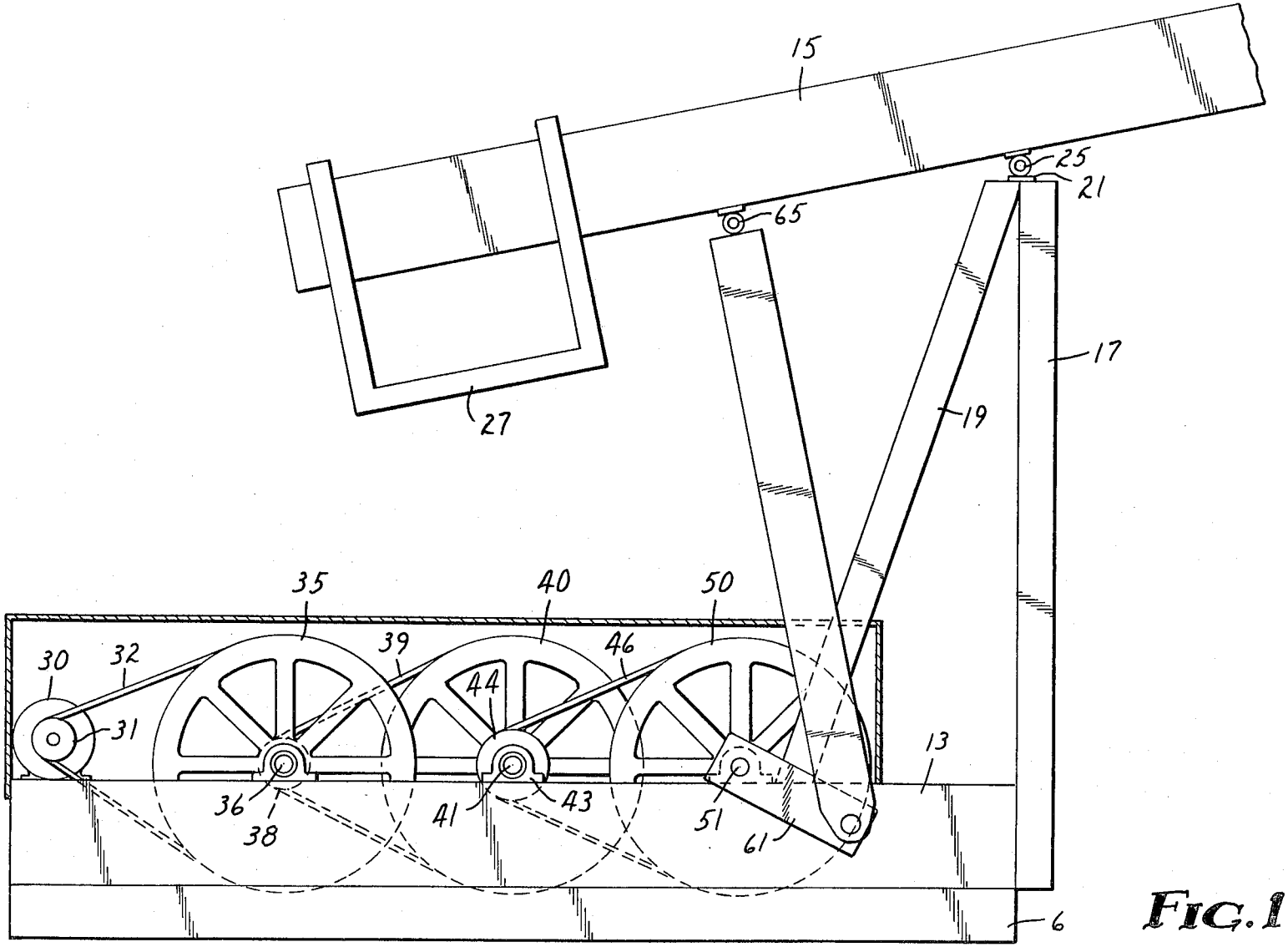
FIG. 1 is a side elevation of the pump operating mechanism of the present invention connected to a pump jack.
Figure 2:
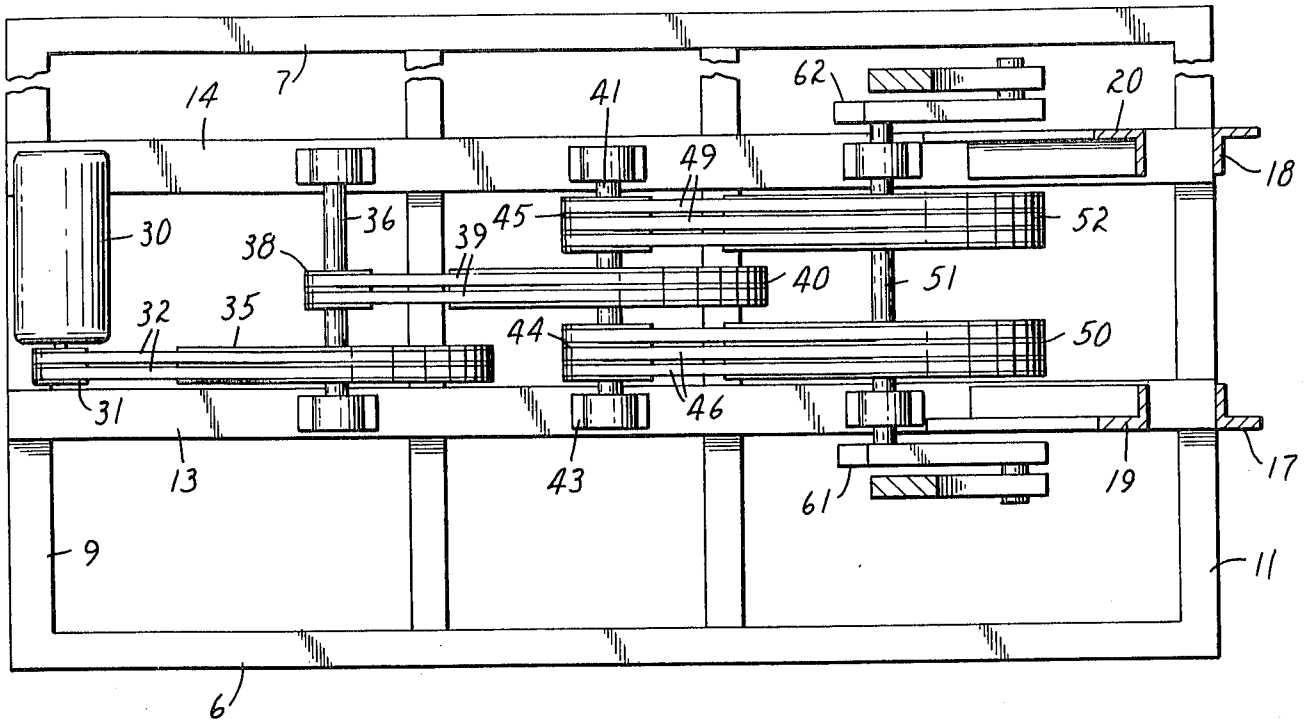
FIG. 2 is a plan view of the pump operating mechanism.

The pump operating drive mechanism of the present invention comprises a first support frame formed by parallel box beams 6 and 7 which are joined by transversely extending beams 9, 10, and 11. Supported by and extending in parallel longitudinal relationship to the main frame are a pair of parallel inverted 10 inch channel beams 13 and 14. The beams 13 and 14 support the drive mechanism. An upright frame is positioned at one end of the support frame to pivotally support a walking beam 15. This upright frame comprises a vertically disposed pair of standing beams 17 and 18 which are braced by a pair of support beams 19 and 20. Joining the beams 17, 18, 19 and 20 is a cross arm 21 which supports a bearing 25 forming a pivotal support for the beam 15. The beam 15 is provided with a head (not shown) at one end to which is attached the string extending from the pump jack beam 15 to the piston of the well pump. The opposite end of the beam 15 is provided with a counterweight generally designated by the reference numeral 27.

The pump operating mechanism supported on the large channel beams 13 and 14 comprises a motor 30 supported on the beams at one end. The motor is provided with a two-groove drive sheave 31. The drive sheave 31 is 4 inches in diameter. A belt 32 connects the drive sheave 31 with a driven sheave 35 positioned on a first shaft 36 journalled in pillow block roller type bearings supported on each of the beams 13 and 14. The driven sheave 35 is 25 inches in diameter preferably. Mounted also on the shaft 36 is a two-groove drive sheave 38, approximately 5 inches in diameter, which supports a drive belt 39 connecting the drive pulley 38 with a driven sheave 30 on a second shaft 31. The second shaft 41 is also mounted in pillow block roller-type bearings indicated at 43. The sheave 30 is 25 inches in diameter and transfers a drive torque to a pair of three-groove drive sheaves 44 and 45 fixed to the shaft 41. The drive sheaves 44 and 45 are three-groove sheaves and are 7 inches in diameter. A belt 46 connects the drive sheaves 44 to a driven sheave 50 on a third shaft 51 and a belt 49 connects the three-groove drive sheave 44 to a driven sheave 52 on the shaft 51 which sheave 52 is identical to sheave 50 and 25 inches in diameter. Connected to opposite ends of the shaft 51, which is rotatably supported in pillow block roller-type bearings supported on the beams 13 and 14, are radially extending crank arms 61 and 62. These crank arms are provided with drive pins at their free ends which are pivotally connected to 5 inch channel connecting links which extend from the crank arms to a pivot point 65 on the beam 15.

The drive afforded by the motor 30 through the three series of belts 32, 39, 46 and 49 afford a drive ratio of approximately 109 to 1 from the motor drive sheave for the walking beam. The system is designed with the drive balanced in that the drive sheave 38 is supported in the center of the shaft 36 which is 1-3/5 inches in diameter to drive the driven sheave 40. Shaft 41 is 1½ inches in diameter and the third drive sheaves on shaft 41 are symmetrically located to drive a pair of symmetrical drive sheaves 50 and 52 supported by a 2 inch shaft 51.

Having described the preferred drive assembly it is to be understood that changes may be apparent to those skilled in the art without departing from the spirit or scope of the invention as defined in the appended claims.

We claim:

1. A pump operating mechanism for a pump jack which comprises:

a walking beam having counterweights on said beam including a head, a fram pivotally supporting said walking beam for oscillating movement of a head about said supporting frame and, a drive mechanism for driving said walking beam to oscillate the same, said drive mechanism comprising:

a drive motor having a drive sheave, a first driven shaft having a driven sheave and a smaller drive sheave, a second driven shaft having a driven sheave and a smaller drive sheave, a third driven shaft having a driven sheave and having a radial crank arm secured thereto, said driven sheaves being of equal diameter, three series of drive belts connecting said drive sheaves to a driven sheave to drive the first shaft from said motor driven sheave, to drive the second shaft from the drive sheave on the first shaft and to drive the third shaft from the drive sheave on the second shaft, and a drive link connecting said crank arms, to said walking beam for pivoting the same about said supporting frame upon operation of said motor, wherein said drive reduction is approximately 109 to 1, wherein said drive reduction is afforded by a drive sheave 4 inches in diameter driven from said drive motor, said second and third drive sheaves being approximately 5 and 7 inches in diameter respectively, and said driven sheaves being 25 inches in diameter.

* * * * *